United States Patent [19]

Kuwamoto et al.

[11] Patent Number: 4,626,367

[45] Date of Patent: Dec. 2, 1986

[54] WATER-SOLUBLE METAL-WORKING LUBRICANT COMPOSITION

[75] Inventors: Hiroshi Kuwamoto, Fukuyama; Hiroyuki Nagamori; Takashi Mukai, both of Wakayama; Shuichi Iwado, Fukuyama, all of Japan

[73] Assignees: Kao Corporation; Nippon Kokan Kabushiki Kaisha, both of Tokyo, Japan

[21] Appl. No.: 786,358

[22] Filed: Oct. 11, 1985

Related U.S. Application Data

[63] Continuation of Ser. No. 615,760, May 31, 1984, abandoned.

[30] Foreign Application Priority Data

Oct. 6, 1983 [JP] Japan ..... 58-103631

[51] Int. Cl.[4] ..... C16M 173/02

[52] U.S. Cl. ..... 252/49.5

[58] Field of Search ..... 252/49.5

[56] References Cited

U.S. PATENT DOCUMENTS 3,213,024 10/1965 Blake ..... 252/49.5
3,459,663 8/1969 Rue ..... 252/49.5
4,377,487 3/1983 Freeman ..... 252/49.5
4,379,063 5/1983 Williams ..... 252/49.5
4,384,965 5/1983 Hellsten ..... 252/49.5
4,419,252 12/1983 Shim ..... 252/49.5

*Primary Examiner*—William R. Dixon, Jr.
*Assistant Examiner*—Cynthia A. Prezlock
*Attorney, Agent, or Firm*—Oblon, Fisher, Spivak, McClelland, & Maier

[57] ABSTRACT

A water-soluble metal-working lubricant composition comprising as essential components thereof (a) one or more polyetherpolyols having molecular weights of 200 to 100,000 and obtained by adding alkylene oxides to either one or more of compounds selected from
  (1) polyalkylenepolyamines and derivatives thereof,
  (2) alkyl- and alkylaryl-amines and derivatives thereof and
  (3) carboxylic acid amides and derivatives thereof; and (b) one or more compounds selected from phosphoric acid compounds and boric acid.

Incorporation of a specific polyetherpolyol compound together with phosphoric acid compound or boric acid serves as alternative to conventional liquid oil-base lubricant with mitigating drawbacks such as poor stability of emulsions, fouling of surfaces, difficulty in waste water, etc., which are inherent in conventional lubricants.

6 Claims, No Drawings

WATER-SOLUBLE METAL-WORKING LUBRICANT COMPOSITION

This application is a continuation, of application Ser. No. 615,760, filed 5/31/84 now abandoned.

BACKGROUND OF THE INVENTION (i) Field of the Invention

This invention relates to a novel, water-soluble, metal-working lubricant composition, and more specifically to a water-soluble metal-working lubricant composition which contains one or more of specific polyetherpolyols and their derivatives and one or more compounds selected from phosphoric acid compounds and boric acid and are useful as a lubricant upon working metals, e.g., upon plastic-working, cutting and grind-working metals or for similar purposes.

(ii) Description of the Prior Art

Liquid-like oil-base lubricants which have conventionally been employed for the plastic working, cutting and grinding of metals are applied to lubricating parts as they are. Besides, they are also emulsified in water to desired concentrations by means of emulsifiers such as surfactants and are applied as emulsions to the surfaces of workpieces upon working the workpieces. Namely, such liquid-like oil-base lubricants feature that their lubricating effects can be obtained by adhesion of droplets of the liquid-like oil-base lubricants emulsified by the surfactants or the like on the surfaces of the workpieces. Liquid-like oil-base lubricants which make use of water are particularly advantageous owing to their cooling effects for heat to be produced upon working workpieces, their economy derived from recirculated use of emulsions, and so on. On the other hand, they are also accompanied by various drawbacks with respect to control of emulsions, which include:

(a) Poor stability of emulsions;

(b) Inclusion of foreign matters such as metal powder, scum and the like, which occur during machining of metals, in emulsions;

(c) Fouling of surfaces of workpieces due to such foreign matters;

(d) Reduction to load resistant capacity due to reduced amounts of emulsified lubricant droplets adhered to surfaces of workpieces, which reduced amounts of emulsified lubricant droplets are induced to ensure stabilized emulsification;

(e) Difficulty in treating waste water produced from emulsions; and (f) Corrosion and rust developed on workpieces, primarily due to used water.

It is thus desired to develop a water-soluble lubricant which can provide beautiful surfaces without leaving any stains, which have tended to occur by lube-oils, on the surfaces of workpieces after completion of their working, and does not permit inclusion of foreign or fouled matters such as metal powder and deteriorated lubricants, in other words, does not hold such foreign and/or fouled matters in the lubricant system and is therefore free from fouling workpieces. Under the present circumstances, there has not yet been found any excellent lubricant which exhibits such advantageous effects.

SUMMARY OF THE INVENTION

The present invention provides a lubricant which can solve the above-mentioned drawbacks of conventional liquid-like oil-base lubricants and is soluble in water. It has been found that the above object can be attained without using any liquid-like oil-base lubricant if one makes use of a composition containing a specific polyetherpolyol or its derivative and a phosphoric acid compound or boric acid.

Accordingly, the present invention provides a water-soluble metal-working lubricant composition comprising as essential components thereof (a) one or more polyetherpolyols having molecular weights of 200–100,000 and obtained by adding alkylene oxides to either one or more of compounds selected from (1) polyalkylenepolyamines and derivatives thereof, (2) alkyl- and alkylaryl-amines and derivatives thereof and (3) carboxylic acid amides and derivatives thereof, or derivatives thereof; and (b) one or more compounds selected from phosphoric acid compounds and boric acid.

DETAILED DESCRIPTION OF THE INVENTION AND PREFERRED EMBODIMENTS

As polyalkylenepolyamines (1) capable of yielding polyetherpolyols or their derivatives which are components (a) in compositions of this invention, may be mentioned ethylenediamine, diethylenetriamine, triethylenetetramine, tetraethylenepentamine, pentaethylenehexamine, propylenediamine, butylenediamine, etc. As their derivatives, may also be mentioned N-alkylated compounds of the above compounds, each of which N-alkylated compounds contains an alkyl group having 4 to 22 carbon atoms, and derivatives of the N-alkylated compounds each of which derivatives contains up to 3 hydroxyl groups in place of the $NH_2$ group or groups contained in the corresponding N-alkylated compound. As the alkyl- or alkylaryl-amines (2), may be mentioned mono- or di-alkylamines each of which contains 4 to 36 carbon atoms, cycloalkylamines each of which contains 3 to 6 carbon atoms, alkylarylamines each of which contains an alkyl group having 4 to 36 carbon atoms and containing at least one phenyl group. Furthermore, as carboxylic acid amides (3), may be mentioned fatty acid amides each of which contains 5 to 54 carbon atoms, polymeric acid amides such as dimeric acids and trimeric acids, and so on.

As alkylene oxides to be added to these compounds (1) to (3), may be mentioned ethylene oxide, propylene oxide, butylene oxide, styrene oxide and the like.

Among polyetherpolyols and their derivatives useful in the practice of this invention, it is preferable to use those obtained using alkylene oxides, which consist individually of ethylene oxide only or ethylene oxide and one or more of propylene oxide, butylene oxide and styrene oxide, and containing as added mole numbers per molecule 1 to 150 moles of ethylene oxide, 0 to 100 moles of propylene oxide, 0 to 100 moles of butylene oxide and 0 to 50 moles of styrene oxide.

As phosphoric acid compounds which are components (b), the following compounds (i) to (v) may be mentioned.

(i) phosphoric acid and phosphorous acid as well as thio compounds and ester compounds thereof;

(ii) mono- and di-phosphoric acid esters containing respectively alkyl, alkylaryl and aryl groups which contain individually at least one hydroxyl group as well as thio compounds thereof;

(iii) mono- or di-phosphonic acids which contain respectively alkyl groups containing 1 to 8 carbon atoms, alkylaryl groups and aryl group and thio compounds thereof, as well as derivatives thereof;

(iv) mono- or di-phosphinic acids which contain respectively alkyl groups having 1 to 8 carbon atoms, alkylaryl groups and aryl group and thio compounds thereof, as well as derivatives thereof; and (v) mono-, di- and tri-phosphonic acids containing one or more nitrogen atoms.

The following compounds may be mentioned as specific examples of the phosphoric acid compounds. As phosphoric acid compounds (i), may be mentioned by way of example phosphoric acid, phosphorous acid, mono- or di-phosphoric acid esters between aliphatic alcohols containing 1 to 8 carbon atoms, alicyclic alcohols or aromatic alcohols and phosphoric acid as well as thio compounds of the mono- or di-phosphoric acid esters, and esters between the above alcohols and phosphorous acid and thio compounds of the esters. As an exemplary phosphoric acid compound (ii), may be mentioned 2-hydroxydipropyl phosphate. Illustrative of the phosphoric acid compounds (iii) may include phosphonic acids represented by the general formula:

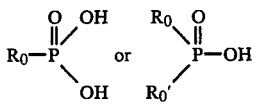

wherein $R_0$ and $R'_0$ mean individually an alkyl group having 1 to 8 carbon atoms, alkylaryl group or aryl group, for example, methylphosphonic acid containing 1 carbon atom, dimethylphosphonic acid to n-octylphosphonic acid containing 8 carbon atoms, di-n-octylphosphonic acid, 2-ethylhexylphosphonic acid, di-2-ethylhexylphosphonic acid, benzylphosphonic acid, dibenzylphosphonic acid, phenylphosphonic acid, diphenylphosphonic acid and hydroxyethanediphosphonic acid, as well as their thiophosphonic acids. Hydroxyethanediphosphonic compound is a compound represented by the following formula:

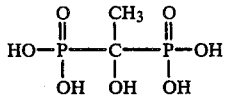

As exemplary phosphoric acid compounds (iv), may be mentioned phosphinic acids represented by the general formula:

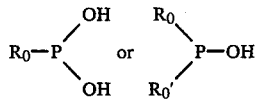

wherein $R_0$ and $R'_0$ have the same meanings as defined above, for example, methylphosphinic acid containing 1 carbon atom, dimethylphosphinic acid to n-octylphosphinic acid containing 8 carbon atoms, di-n-octylphosphinic acid, 2-ethylhexylphosphinic acid, di-2-ethylhexylphosphinic acid, benzylphosphinic acid, dibenzylphosphinic acid, phenylphosphinic acid and diphenylphosphinic acid, as well as their thiophosphinic acids. As compounds (v), may for example by mentioned hexamethylphosphoric mono-(or di- )amide and nitrilotrismethylenephosphonic acid. Nitrilotrismethylenephosphonic acid is a compound represented by the following formula:

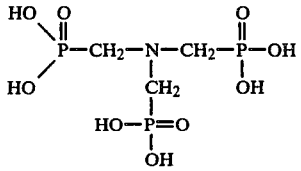

Although the mechanism of action achieved to the lubricity owing to the use of the polyetherpolyol and the acidic phosphoric acid or boric acid in accordance with this invention has not been fully elucidated, they seem to act probably in the following manner. Namely, when an aqueous solution containing the polyetherpolyol and boric acid or the phosphoric acid compound is supplied to a working part of a metal during the working of the metal, the polyetherpolyol forms a film, in which boric acid or the phosphoric acid compound is firmly adsorbed, over the working part of the metal owing to the strong adsorptive action of groups derived from the nitrogen atoms and at the same time, a still stronger film is formed owing to adsorption of boric acid or the phosphoric acid compound or reaction with the metal. As a result, the strong absorptive film of the polyetherpolyol serves, even under severe metal-working conditions, in much the same way as a strong oil film formed when a lube-oil is used. It is also believed that still better lubricity can be achieved when boric acid or the phosphoric acid compound is kept in contact with the metal, because an adsorbed film or reaction film is formed on the surface of the metal.

The water-soluble metal-working lubricant composition of this invention is prepared as a mixture of one or more of these polyetherpolyols and one or more of these polyetherpolyols and one or more of boric acid and the phosphoric acid compounds. It may also be formed into an aqueous solution by adding water thereto. In addition, it is also feasible to add, besides the above components, various known additives as needed, for example, an antioxidant, e.g., a phenolic antioxidant such as 2,4-di-t-butyl-p-cresol or an aromatic aminetype antioxidant such as phenyl-alpha-naphthylamine; a water-soluble thickener such as a polyethyleneglycol carboxylate; a water-soluble oilness agent, e.g., a metal salt, amine salt or sorbitan derivative of a carboxylic acid such as lauric acid, palmitic acid, oleic acid or stearic acid; a water-soluble rust and corrosion preventive; and so on. These various additives may each be added in a proportion of 0 to 10% based on the whole amount of each water-soluble metal-working lubricant composition whenever necessary.

As water-soluble rust and corrosion preventive, may for example be mentioned an inorganic compound such as chromate, nitrite, molybdate, tungstate, polyphosphate or the like; (1) a monoamine, diamine or amide as a sole compound or an ethoxyl compound, mono-basic acid salt, di-basic acid salt, naphthenate or phosphate thereof, or either one of the various salts exemplified above as inorganic compounds; (2) an alkali salt of an amino acid; (3) an imidazoline derivative; (4) a quaternary ammonium salt; or (5) an inorganic compound such as mercaptobenzotriazole.

Furthermore, it is also possible to use sulfur or sulfur compound, which contains unpaired electrons, within the range of 1.2 to 4.0 wt % as a compound based on the whole composition in accordance with what end use would be made. As sulfur and sulfur compounds, may be mentioned by way of example elementary sulfur, sulfurous acid, mercaptans containing such hydrocarbon groups as aliphatic, alicyclic and aromatic hydrocarbon groups, sulfides (inclusive of thiophenes), and polysulfides such as disulfides and trisulfides.

Besides, it is also feasible to use one or more of various known surfactants in a total amount of 20% or less based on the polyetherpolyols from the viewpoint of the stability of each composition upon mixing various additives therein.

The water-soluble metal-working lubricant composition of this invention is used, whenever needed, by diluting it with water to a concentration of 100 to 500,000 ppm or preferably 1,000 to 50,000 ppm upon its application.

Application of an aqueous solution of the water-soluble metal-working lubricant composition of this invention to each working part may be effected by the spraying technique or immersion technique. When applied in such a way, the aqueous solution of the composition does not show any deterioration to its performance such as lubricity which deterioration is generally liable to occur due to inclusion of fouled matters and/or scum. Therefore, it may be repeatedly used by recirculating same.

The thus-obtained water-soluble metal-working lubricant composition according to this invention has the following merits while still maintaining the high cooling effect with which lubricants making use of water and applied in the forms of emulsions are equipped:

(1) It provides excellent lubricity upon working a metal, as it has, in the state of an aqueous solution, load resistant capacity either equal to or higher than conventional liquid-type lubricants even if it does not contain an oily, liquid-type lubricant such as mineral oil, beef tallow or fatty acid.

(2) It can provide beautiful surfaces after working, because it does not contain any solid lubricants or oily, liquid-type lubricants.

(3) The composition has strong adhesion to metal powder and fouled oil to be formed in the course of working a metal. These matters are thus rendered hydrophilic and are therefore prevented from resticking on the metal. In addition, the composition does not had interfacial activity. Therefore, it is possible to avoid emulsification and inclusion of fouled oil, thereby making it possible to keep the surface or each workpiece clean and during working, to maintain the environment clean.

(4) It facilitates treatment of waste water, because it does not use such emulsifiers as those employed in oily, liquid-type lubricants.

(5) It is safer from the viewpoint of hazard prevention, since it is used as an aqueous solution.

When it is desired to use water for such reasons as placement of importance on cooling or prevention of oil vapor, the composition of this invention can be used more effectively for example in the fields of plastic working of metals, cutting of metals, grind-working of metals, etc. Furthermore, it may be possible to expand the application fields of the composition of this invention to such working fields where general lubricants are employed due to possible generation of heat or possible application of heat.

In addition, the composition of this invention showed excellent effects toward maintaining the surfaces of workpieces and when applied in actual machining, keeping the environment clean, owing to its re-adhesion preventory effect for metal powder and fouled oil produced in the course of working metals. The readhesion preventory effect has been brought about owing to the conversion of such metal powder and fouled oil into hydrophilic matters, which conversion has in turn been materialized owing to the strong adhesion of the composition of the present invention.

As has been described above, the present invention has excellent features and has a great value from the viewpoint of commercial utility.

The invention will next be described with reference to Examples.

The following metal-working lubricant compositions were used in the Examples. Besides, the following compounds or substances were also used respectively as polyolethers, phosphoric acid compounds, an emulsifier, an antioxidant, an extreme-pressure additive, water-soluble rust preventives, water-soluble oilness agents, sulfur compounds containing unpaired electrons, and surfactants:

Polyetherpolyols (1) A polyetherpolyol obtained by adding, to ethylenediamine, 5 moles of propylene oxide and then adding 15 moles of ethylene oxide;

(2) A polyetherpolyol obtained by adding 10 moles of ethylene oxide to N-lauryltriethylenetetramine;

(3) A polyetherpolyol obtained by adding 15 moles of ethylene oxide to N-coconutalkyldiethylenetriamine;

(4) A polyetherpolyol obtained by adding 2 moles of butylene oxide to N-octylpropylenedimaine, followed by an addition of 8 moles of ethylene oxide;

(5) A polyetherpolyol obtained by adding 5 moles of ethylene oxide to laurylamine;

(6) A polyetherpolyol obtained by adding 3 moles of propylene oxide to oleylbutylamine, followed by an addition of 12 moles of ethylene oxide;

(7) A polyetherpolyol obtained by adding 6 moles of ethylene oxide to cyclohexylamine;

(8) A polyetherpolyol obtained by adding 18 moles of ethylene oxide to the amide of a polymeric acid (dimeric acid/polymeric acids of trimeric acid and up=8/2) of oleic acid; and (9) A polyetherpolyol obtained by adding 3 moles of propylene oxide to the amide of a polymeric acid (dimeric acid/polymeric acids of trimeric acid and up=7/3) of fatty acids derived from toll oil, followed by a further addition of 20 moles of ethylene oxide.

(10) A polyetherpolyol obtained by adding 15 moles of ethylene oxide to the amide of coconut fatty acid.

Phosphoric acid compounds (1) Phosphoric acid;
(2) Butylphosphonic acid;
(3) Boric acid;
(4) Dibutylthiophosphonic acid; and
(5) Butyl acid phosphate.

Emulsifier

Polyoxyethylenenonyl phenyl ether (HLB=7.8)

Antioxidant 2,4-Di-t-butyl-p-cresol

Extreme-pressure additive

Triphenyl phosphite.

Water-soluble rust preventives (1) The amine salt of butyl laurate;

(2) Sodium N-coconutalkyl-betaiminodipropionate (80 parts) and benzotriazole (20 parts); and (3) Sodium (beef tallow) alkenylsuccinate.

Water-soluble oilness agents (1) The sodium salts of fatty acids derived from beef tallow; and (2) The butylamine salts of polymeric fatty acids derived from beef tallow (dimeric acid/polymeric acids of trimeric acid and up=7/3).

Sulfur compounds containing unpaired electrons (1) Dilauryl sulfide;

(2) Butyl mercaptan; and (3) Dipropyl disulfide.

Surfactants (1) Polyoxyethylenenonyl phenyl ether (HLB=12.5);

(2) Sorbitan monooleate/polyoxyethylenesorbitan monolaurate (HLB=16.7)=1/4 (by weight ratio); and (3) Oxyethylene-oxypropylene block polymer (the weight percentage of ethylene oxide in the whole molecules is 40 and the block polymer has a molecular weight of about 2,250).

-continued

| | |
|---|---|
| Fatty acids derived from beef tallow | 2 |
| Emulsifier | 2 |
| Antioxidant | 1 |
| Comparative product No. 2: | |
| Lube-oil component: | |
| Beef tallow | 94% |
| Fatty acids derived from beef tallow | 2 |
| Extreme-pressure additive | 1 |
| Emulsifier | 2 |
| Antioxidant | 1 |
| Comparative product No. 3: | |
| Lube-oil component: | |
| Mineral oil (cylinder oil) | 77% |
| Pentaerythritol tetraoleate | 20 |
| Emulsifier | 2 |
| Antioxidant | 1 |
| Comparative product No. 4: | |
| Lube-oil component: | |
| Mineral oil (cylinder oil) | 76% |
| Pentaerythritol tetraoleate | 20 |
| Extreme-pressure additive | 1 |
| Emulsifer | 2 |
| Antioxidant | 1 |
| Comparative product No. 5: | |
| Lube-oil component: | |
| Mineral oil (spindle oil) | 72% |
| Octyl stearate | 20 |
| Oleic acid | 5 |
| Emulsifier | 2 |
| Antioxidant | 1 |

TABLE 1

| | Composition* (wt %) Invention Product | | | | | |
|---|---|---|---|---|---|---|
| | Polyether-polyol Compound No. (Concentration) | Phosphoric Acid Compound Compound No. (Concentration) | Water-Soluble Oilness Agent Compound No. (Concentration) | Water-Soluble Rust Preventive Compound No. (Concentration) | Sulfur Compound Containing Unpaired Electrons Compound No. (Concentration) | Surfactant Compound No. (Concentration) |
| 1 | 1 (40) | 1 (10) | | | | |
| 2 | 2 (40) | 2 (10) | | | | |
| 3 | 3 (40) | 3 (10) | | | | |
| 4 | 4 (40) | 4 (10) | | | | |
| 5 | 5 (40) | 5 (10) | | | | |
| 6 | 6 (40) | 1 (20) | | | | |
| 7 | 7 (40) | 2 (20) | | | | |
| 8 | 8 (40) | 3 (20) | | | | |
| 9 | 9 (40) | 4 (20) | | | | |
| 10 | 10 (40) | 5 (20) | | | | |
| 11 | 1 (60) | 1 (30) | | | | |
| 12 | 2 (60) | 2 (30) | 1 (10.0) | | | |
| 13 | 3 (60) | 3 (30) | 2 (10.0) | | | |
| 14 | 4 (60) | 4 (30) | 1 (8.0) | | | |
| 15 | 5 (60) | 5 (30) | 2 (8.0) | | | |
| 16 | 6 (60) | 1 (5) | 1 (5.0) | | | |
| 17 | 7 (60) | 2 (5) | 2 (5.0) | | | |
| 18 | 8 (60) | 3 (5) | 1 (3.0) | | | |
| 19 | 9 (60) | 4 (5) | 2 (3.0) | 1 (5.0) | | |
| 20 | 10 (60) | 5 (5) | 1 (2.0) | 2 (5.0) | | |
| 21 | 1 (30) | 1 (3) | 2 (2.0) | 3 (5.0) | | |
| 22 | 2 (30) | 2 (3) | 1 (1.0) | 1 (3.0) | 1 (2.0) | 1 (1.0) |
| 23 | 3 (30) | 3 (3) | 2 (1.0) | 2 (3.0) | 2 (2.0) | 2 (1.0) |
| 24 | 4 (30) | 4 (3) | 1 (3.0) | 3 (3.0) | 3 (2.0) | 3 (1.0) |
| 25 | 5 (30) | 5 (3) | 2 (3.0) | 1 (2.0) | 1 (1.5) | 1 (2.0) |
| 26 | 6 (30) | 1 (5) | 1 (4.0) | 2 (2.0) | 2 (1.5) | 2 (2.0) |
| 27 | 7 (30) | 2 (5) | 2 (4.0) | 3 (2.0) | 3 (1.5) | 3 (2.0) |
| 28 | 8 (30) | 3 (5) | 1 (5.0) | 1 (10.0) | 1 (3.0) | 1 (3.0) |
| 29 | 9 (30) | 4 (5) | 2 (5.0) | 2 (10.0) | 3 (3.0) | 3 (3.0) |
| 30 | 10 (30) | 5 (5) | 1 (3.0) | 3 (10.0) | 3 (3.0) | 3 (3.0) |

*The remainders are water.

| | |
|---|---|
| Comparative product No. 1: | |
| Lube-oil component: | |
| Beef tallow | 95% |

| | |
|---|---|
| Comparative product No. 6: | |
| Lube-oil component: | |
| Mineral oil (spindle oil) | 71% |
| Octyl stearate | 20 |
| Oleic acid | 5 |

-continued

| | |
|---|---|
| Extreme-pressure additive | 1 |
| Emulsifier | 2 |
| Antioxidant | 1 |

Example 1

Seizure-Resistant Loading Test

(Falex Testing Method)

The measurement of seizure-resistant loads was carried out in accordance with ASTM Standard D-3233 Pressure Resistant Loading Test (Falex Test). The preparation of each test sample was carried out by diluting each metal-working oil composition with water to a concentration of 3% and then mixing the resultant mixture at 10,000 rpm in a homogenizer. The coating of each test sample was effected by applying the above-mixed solution to a rotary pin, which was disposed centrally in a fixed block, at a spray rate of 50 ml/min (a pressure of 0.5 kg/cm$^2$) and a dispersion temperature of 50° C. by means of a gear pump.

Results are given in Table 2.

TABLE 2

| Metal-Working Oil Composition | Concentration of Aqueous Solution (wt %) | Seizure Resistant Load (lbs.) |
|---|---|---|
| Invention Product No. | | |
| 1 | 4.0 | 1500 |
| 2 | " | 1500 |
| 3 | " | 1750 |
| 4 | " | 1500 |
| 5 | " | 1750 |
| 6 | 5.0 | 1750 |
| 7 | " | 1500 |
| 8 | " | 1500 |
| 9 | " | 1750 |
| 10 | " | 1750 |
| 11 | 1.0 | 1750 |
| 12 | " | 1750 |
| 13 | " | 1750 |
| 14 | " | 1750 |
| 15 | 2.0 | 2000 |
| 16 | " | 2000 |
| 17 | " | 1750 |
| 18 | " | 1750 |
| 19 | 1.0 | 1750 |
| 20 | " | 1750 |
| 21 | " | 2000 |
| 22 | " | 1750 |
| 23 | 0.5 | 2000 |
| 24 | " | 2000 |
| 25 | " | 1750 |
| 26 | " | 1750 |
| 27 | 0.2 | 1750 |
| 28 | 3.0 | 2000 |
| 29 | 1.0 | 2000 |
| 30 | 0.5 | 1750 |
| Comparative Product No. | | |
| 1 | 3.0 | 1000 |
| 2 | " | 1250 |
| 3 | " | 750 |
| 4 | " | 1000 |
| 5 | " | 750 |
| 6 | " | 1000 |

What is claimed is:

1. A non-oil based water-soluble metal-working lubricant composition comprising as essential components thereof:

(a) one or more polyetherpolyols having molecular weights of 200 to 100,000 and obtained by adding alkylene oxides to one or more compounds selected from the group consisting of:

(1) polyalkylenepolyamines selected from the group consisting of ethylenediamine, diethylenetriamine, triethylenetetramine, tetraethylenepentamine, pentaethylenehexamine, propylenediamine, and butylenediamine, ($C_4$–$C_{22}$) N-alkylated derivatives thereof and derivatives thereof which may further contain up to 3 hydroxyl groups in place of the $NH_2$ groups; and (2) alkyl- and alkylaryl-amines selected from the group consisting of ($C_4$–$C_{36}$) mono- or dialkylamines, ($C_3$–$C_6$) cycloalkylamines, and ($C_4$–$C_{36}$) alkylarylamines having at least one phenyl group; and (b) one or more compounds selected from the group consisting of boric acid and phosphoric acid compounds selected from the group consisting of:

(i) phosphoric acid, phosphorous acid, thio compounds thereof and mono- or di- ($C_1$–$C_8$) alkyl ester compounds thereof;

(ii) mono- and di-phosphoric acid esters containing alkyl group containing at least one hydroxyl group, and thio compounds thereof;

(iii) mono- and di-phosphoric acids which contain ($C_1$–$C_8$) alkyl groups and thio compounds thereof;

(iv) mono- and di-phosphinic acids which contain ($C_1$–$C_8$) alkyl groups and thio compounds thereof; and (v) mono-, di- and tri-phosphonic acids containing one or more nitrogen atoms.

2. The non-oil-based water-soluble metal-working lubricant composition according to claim 1, wherein the one or more compounds selected from the phosphoric acid compounds and boric acid is contained in an amount of 0.1 to 50 wt % based on the one or more polyetherpolyols or their derivative.

3. The non-oil-based water-soluble metal-working lubricant composition according to claim 1, wherein the alkylene oxides are selected from the group consisting of ethylene oxide, propylene oxide, butylene oxide and stryene oxides.

4. The non-oil-based water-soluble metal-working lubricant composition according to claims 1 or 3 wherein the alkylene oxides consist (a) solely of ethylene oxide, or (b) ethylene oxide and one or more compounds selected from the group consisting of propylene oxide, butylene oxide and styrene oxide.

5. The non-oil-based water-soluble metal-working lubricant of claim 1 wherein the phosphoric acid compounds of (b) are selected from the group consisting of:

(i) phorphoric acid, phosphorous acid, mono- or di-phosphoric acid esters of ($C_1$–$C_8$) aliphatic alcohols, alicyclic alcohols or aromatic alcohols and phosphoric acid, thio compounds of the mono- and di-phosphoric acid esters, esters of the above alcohols and phosphorous acid, and thio compounds thereof;

(ii) 2-hydroxydipropyl phosphate;

(iii) phosphonic acids selected from the group consisting of ($C_1$) methylphosphonic acid, dimethylphosphonic acid, n-octylphosphonic acid, di-n-octylphosphonic acid, 2-ethylhexylphosphonic acid, di-2-ethylhexylphosphonic acid, benzylphosphonic acid, dibenzylphosphonic acid, phenylphosphonic acid, diphenylphosphonic acid, thiophosphonic acids thereof, and a hydroxyethanediphosphonic compound of the following formula:

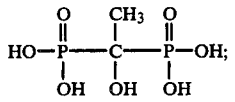

(iv) phosphinic acids of the formula:

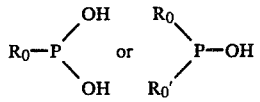

wherein $R_O$ and $R'_O$ are selected from the group consisting of ($C_1$) methylphosphinic acid, dimethylphosphinic acid, n-octylphosphinic acid, di-n-octylphosphinic acid, 2-ethylhexylphosphinic acid, di-2-ethylhexylphosphinic acid, benzylphosphinic acid, dibenzylphosphinic acid, phenylphosphinic acid, diphenylphosphinic acid, and thiophosphinic acids thereof; and (v) mono-, di- and tri-phosphonic acids containing one or more nitrogen atoms selected from the group consisting of hexamethylphosphoric mono- (or di-) amide and nitrilotrismethylenephosphonic acid of the formula:

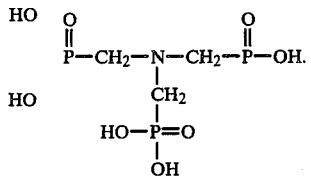

6. A non-oil based water-soluble metal-working lubricant composition comprising as essential components thereof, the components (a) one or more polyetherpolyols having molecular weights of 200 to 100,000 and obtained by adding alkylene oxides to one or more compounds selected from the group consisting of (1) polyalkylenepolyamines selected from the group consisting of ethylenediamine, diethylenetriamine, triethylenetetramine, tetraethylenepentamine, pentaethylenehexamine, propylenediamine, and butylenediamine, ($C_4$–$C_{22}$) N-alkylated derivatives thereof, and derivatives thereof which may further contain up to 3 hydroxyl groups in place of the $NH_2$ groups, and (2) alkyl- and alkylaryl-amines selected from the group consisting of ($C_4$–$C_{36}$) mono- or di-alkylamines, ($C_4$–$C_6$) cycloalkylamines, and ($C_4$–$C_{36}$) alkylarylamines having at least one phenyl group, and (b) one or more compounds selected from the group consisting of boric acid and phosphoric acid compounds selected from the group consisting of:

(i) phosphoric acid, phosphorous acid, thio compounds thereof and mono- or di ($C_1$–$C_8$) alkyl ester compound thereof;

(ii) mono- and di-phosphoric acid esters containing alkyl group containing at least one hydroxyl group, and thio compounds thereof;

(iii) mono- and di-phosphonic acids which contain ($C_1$–$C_8$) alkyl groups and thio compounds thereof;

(iv) mono- and di-phosphinic acids which contain ($C_1$–$C_8$) alkyl groups and thio compounds thereof; and (v) mono-, di- and tri-phosphonic acids containing one or more nitrogen atoms; in an added amount of between 62 and 100 wt. % of the total composition.

* * * * *